US010820734B1

(12) United States Patent
Yu

(10) Patent No.: US 10,820,734 B1
(45) Date of Patent: Nov. 3, 2020

(54) POSITIONING STRUCTURE OF CURTAIN ROD

(71) Applicant: ARLINEA INDUSTRIES CO., Taoyuan (TW)

(72) Inventor: Yu-Heng Yu, Taoyuan (TW)

(73) Assignee: ARLINEA INDUSTRIES CO., Taoyuan (TW)

( * ) Notice: Subject to any disclaimer, the term of this patent is extended or adjusted under 35 U.S.C. 154(b) by 0 days.

(21) Appl. No.: 16/529,777

(22) Filed: Aug. 1, 2019

(51) Int. Cl.
*A47H 1/14* (2006.01)
*A47H 1/142* (2006.01)

(52) U.S. Cl.
CPC ..... *A47H 1/142* (2013.01)

(58) Field of Classification Search
CPC ..... A47K 3/38; A47H 1/142; A47F 5/00
See application file for complete search history.

(56) References Cited

U.S. PATENT DOCUMENTS 3,285,668 A * 11/1966 Fearon ..... E21C 35/19 299/109
4,150,753 A * 4/1979 Stahl ..... A47F 5/13 211/105.1
4,316,546 A * 2/1982 Varon ..... A47F 5/0838 211/105.1
4,455,007 A * 6/1984 Varon ..... A47F 5/00 248/251
4,874,148 A * 10/1989 Guinter ..... A47B 57/42 248/220.22
2017/0071390 A1* 3/2017 Moss ..... A47H 1/142

* cited by examiner

*Primary Examiner* — Amy J. Sterling
(74) *Attorney, Agent, or Firm* — Chun-Ming Shih; HDLS IPR Services

(57) ABSTRACT

A curtain rod positioning structure includes a supporting plate (10) and a block component (20). The supporting plate (10) includes a plate (11), a bearing opening (12) provided on the plate and a buckling hole (13) communicated with the bearing opening (12), and the bearing opening has a supporting surface (121) to attach the curtain rod. The block component (20) includes a cylinder (21) being capable of inserting in the buckling hole and at least one elastomer (22) connected with the cylinder (21), and a side of the elastomer protruded the supporting surface is able to push against the curtain rod disposed in the bearing opening, so that the curtain rod can be positioned between the elastomer and the supporting surface. Therefore, the curtain rod is positioned and a curtain can be moved smoothly thereon.

20 Claims, 9 Drawing Sheets

1

POSITIONING STRUCTURE OF CURTAIN ROD

BACKGROUND OF THE INVENTION

Field of the Invention

The present invention generally relates to curtain rod bracket and, in particular to positioning structures of curtain rod.

Description of Prior Art

Generally speaking, brackets of curtain rods are often attached on wall for loading curtain rods when we install curtains. Besides, curtains hung on curtain rods can perform a shielding motion to achieve the purpose of controlling light outdoors entering the room.

Conventional curtain brackets are usually made according to types of curtain rods, so the brackets must be made according to different types and sizes of curtain rods. However, in real practice, when a curtain rod is placed on the bracket, the curtain rod may be moved due to gaps existed between the bracket and the curtain rod; therefore, the movement of the curtain is not stable and smooth that needs to be improved.

In view of the above drawbacks, the Inventor proposes the present invention based on his expert knowledge and elaborate researches in order to solve the problems of prior art.

SUMMARY OF THE INVENTION

Accordingly, an object of the present invention is to provide a curtain rod positioning structure for stabilizing a curtain rod, so that a curtain can be moved smoothly thereon. In order to achieve the object mentioned above, the present invention provides a curtain rod positioning structure including a supporting plate and a block component. The supporting plate includes a plate, a bearing opening provided on the plate and a buckling hole communicated with the bearing opening, and the bearing opening has a supporting surface to attach the curtain rod. The block component includes a cylinder being capable of inserting in the buckling hole and at least one elastomer connected with the cylinder, and a side of the elastomer protruded the supporting surface is able to push against the curtain rod disposed in the bearing opening, so that the curtain rod can be positioned between the elastomer and the supporting surface. Therefore, the curtain rod is positioned and a curtain can be moved smoothly thereon.

Comparing to the prior art, the curtain rod positioning structure has a supporting plate provided with a bearing opening and a buckling hole communicated with the bearing opening. Further, a block component with elastomers is combined in the buckling hole. Thereby, when a curtain rod is placed in the bearing opening, the elastomers will push against the curtain rod in the carrying opening to position the curtain rod for stabilizing the curtain rod, so that a curtain can be smoothly moved thereon.

BRIEF DESCRIPTION OF DRAWING

The features of the invention believed to be novel are set forth with particularity in the appended claims. The invention itself, however, may be best understood by reference to the following detailed description of the invention, which describes a number of exemplary embodiments of the invention, taken in conjunction with the accompanying drawings, in which:

DETAILED DESCRIPTIONS OF THE PREFERRED EMBODIMENTS

In cooperation with attached drawings, the technical contents and detailed description of the invention are described thereinafter according to a number of preferable embodiments, being not used to limit its executing scope. Any equivalent variation and modification made according to appended claims is all covered by the claims claimed by the present invention.

Please refer to FIG. 1 to FIG. 4, which depict a perspective explosion schematic view, a perspective schematic view, an operation schematic view and a side view of curtain rod positioning structure of the present invention. The curtain rod positioning structure 1 comprises a supporting plate 10 and a block component 20. The block component 20 is combined on the supporting plate 10 for positioning a curtain rod 2. More detail descriptions of the curtain rod positioning structure 1 are as follows.

Figure 1:
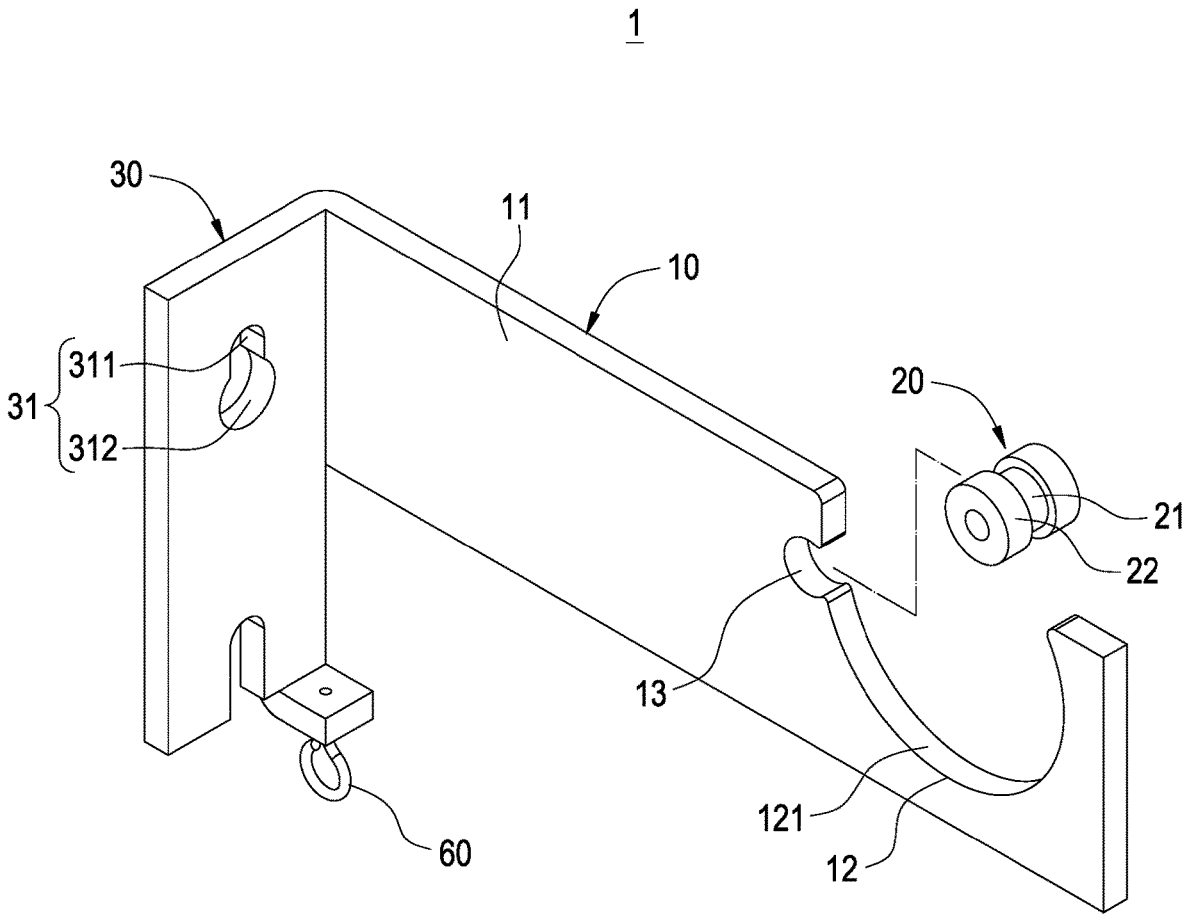
FIG. 1 is a perspective explosion schematic view of curtain rod positioning structure of the present invention.

As shown in FIG. 1, the supporting plate 10 includes a plate 11, a bearing opening 12 provided on the plate 11 and a buckling hole 13 communicated with the bearing opening 12, and the bearing opening 12 has a supporting surface 121 to attach the curtain rod 2. Preferably, the buckling hole 13 is located at a diameter location of the bearing opening 12, and the location is at the widest position of the bearing opening 12, so that the block component 20 can be easily pressed and snapped into the bearing opening 12 without being pulled out.

The block component 20 includes a cylinder 21 being capable of inserting in the buckling hole 13 and at least one elastomer 22 connected with the cylinder 21. In an embodiment of the present invention, the block component 20 includes a pair of elastomers 22, and the pair of elastomers 22 are located at opposite sides of the cylinder 21. Preferably, the block component 20 is made of rubber or plastic.

Figure 2:
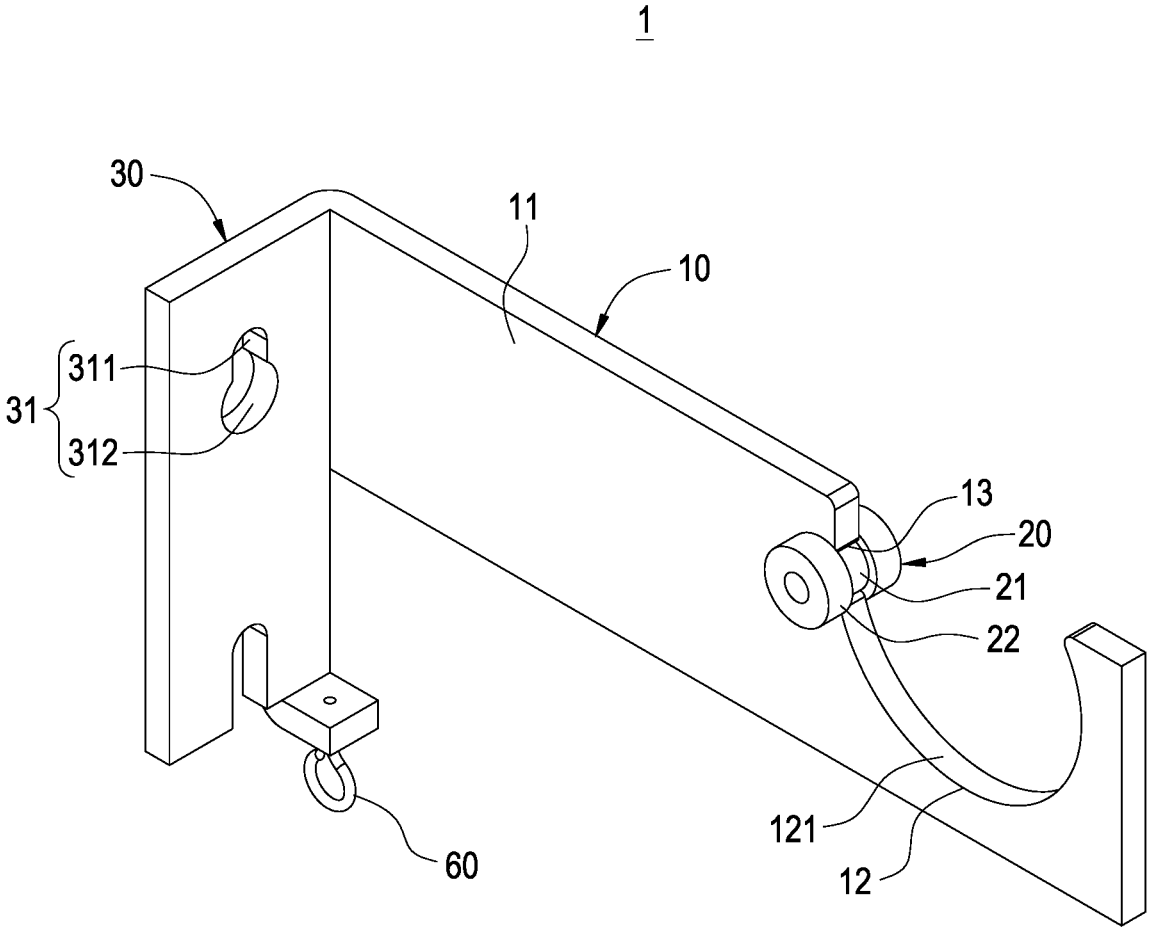
FIG. 2 is a perspective schematic view of curtain rod positioning structure of the present invention.

Also shown in FIG. 2, after the block component 20 is partially assembled into the buckling hole 13 of the supporting plate 10, the pair of elastomers 22 are respectively located on two outer sides of the buckling hole 13, and one side of the elastomer 22 is protruded the supporting surface 121 of the bearing opening 12.

Specifically, the curtain rod positioning structure 1 further includes a fixing plate 30 connected with the supporting plate 10. The fixing plate 30 has a locking hole 31, and the locking hole 31 is provided for inserting a fastening component (not shown); the fixing plate 30 can be combined on a fixing plane through the fastening component. Preferably, the supporting plate 10 is perpendicularly connected to one side of the fixing plate 30. Besides, the locking hole 31 includes a positioning hole 311 and a through hole 312 which are connected to each other and have different aperture sizes, and an aperture diameter of the through hole 312 is larger than an aperture diameter of the positioning hole 311.

Figure 3:
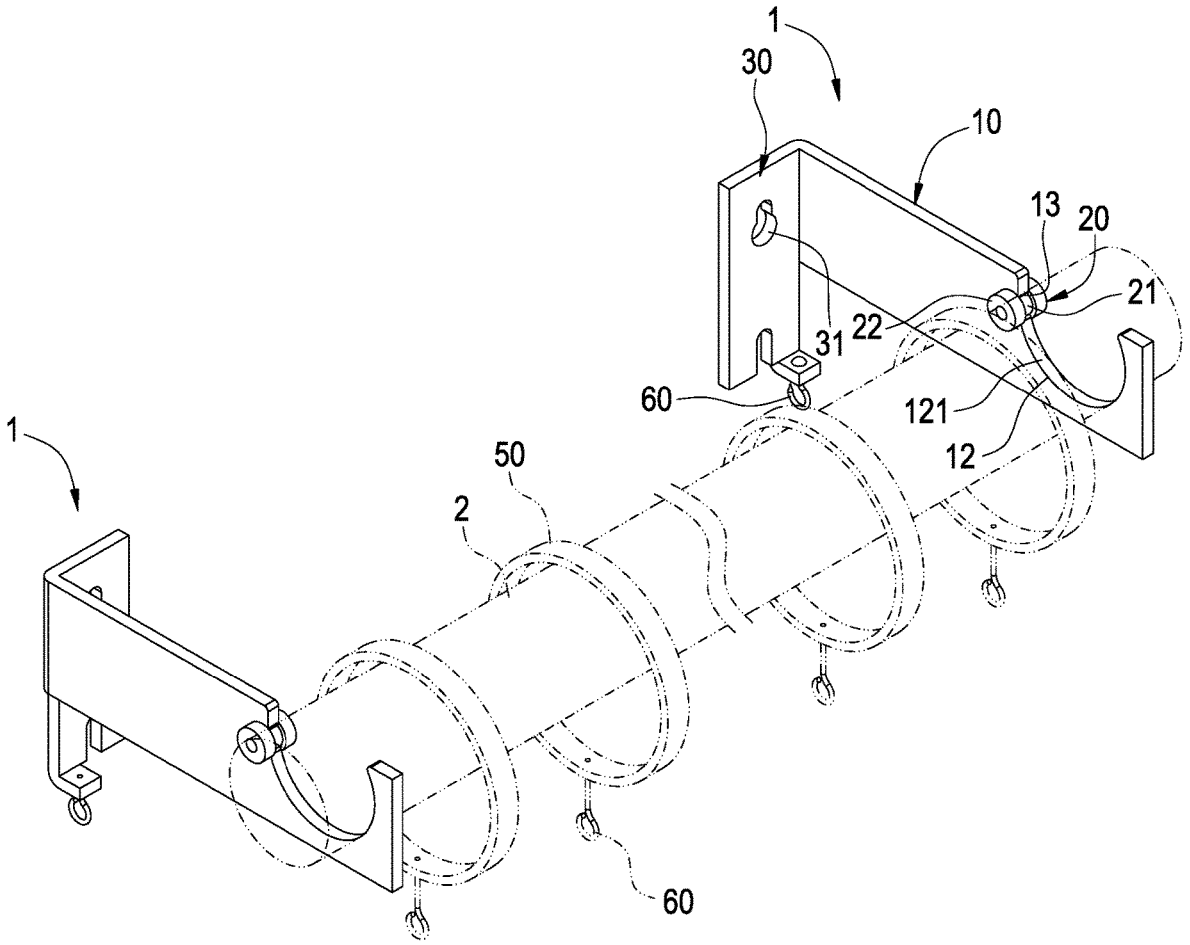
FIG. 3 is an operation schematic view of curtain rod positioning structure of the present invention.
Figure 4:
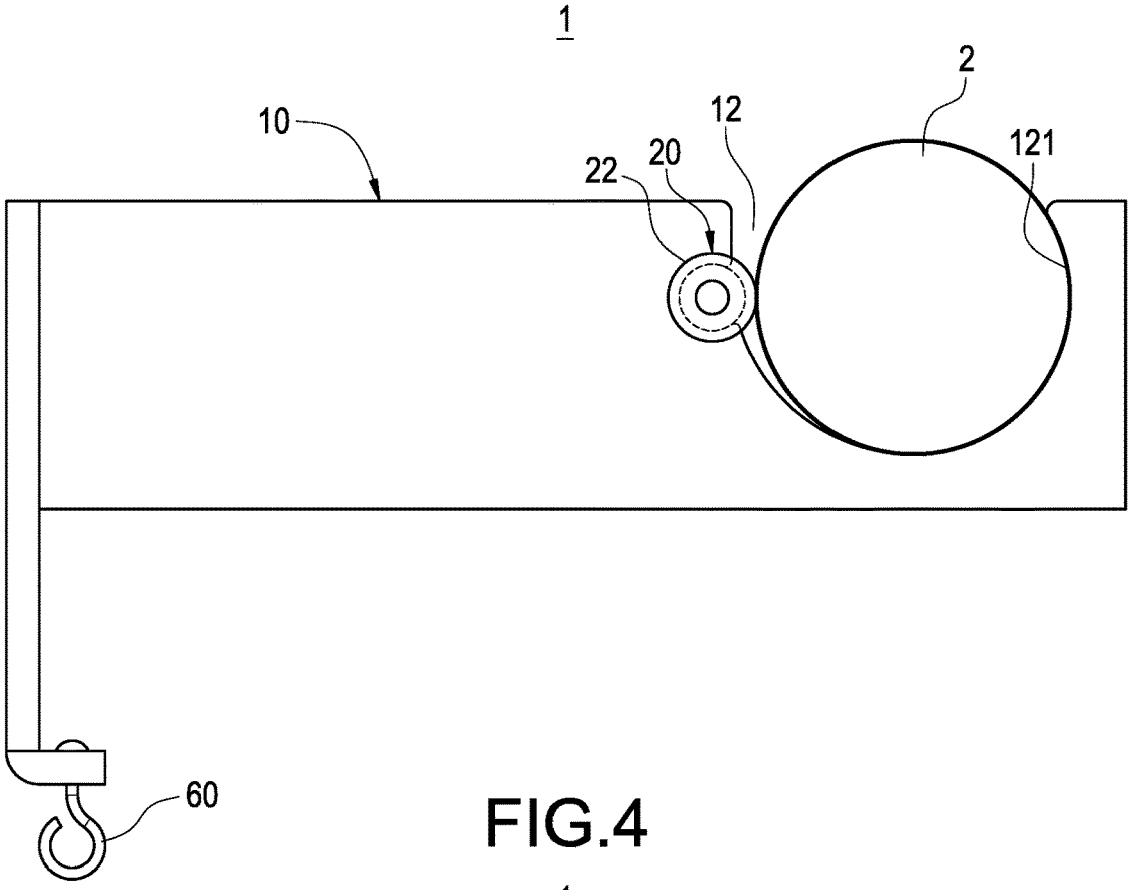
FIG. 4 is a side view of curtain rod positioning structure of the present invention.

Please refer to FIG. 3 and FIG. 4, the curtain rod positioning structure 1 of the present invention is provided for positioning a curtain rod 2. When the curtain rod 2 is placed in the bearing opening 12, the elastomers 22 which protruded the supporting surface 121 is able to push against the curtain rod 2 in the carrying opening 12, so that the curtain rod 2 is positioned between the elastomers 22 and the support surface 121.

It is worthy to note that, the curtain rod positioning structure 1 further includes a hanging ring 50, and a bottom side of the hanging ring 50 is combined with a screw eye 60 for combining a curtain. In addition, a bottom of the fixing plate 30 is also disposed with a screw eye 60 to position the curtain.

Figure 5:
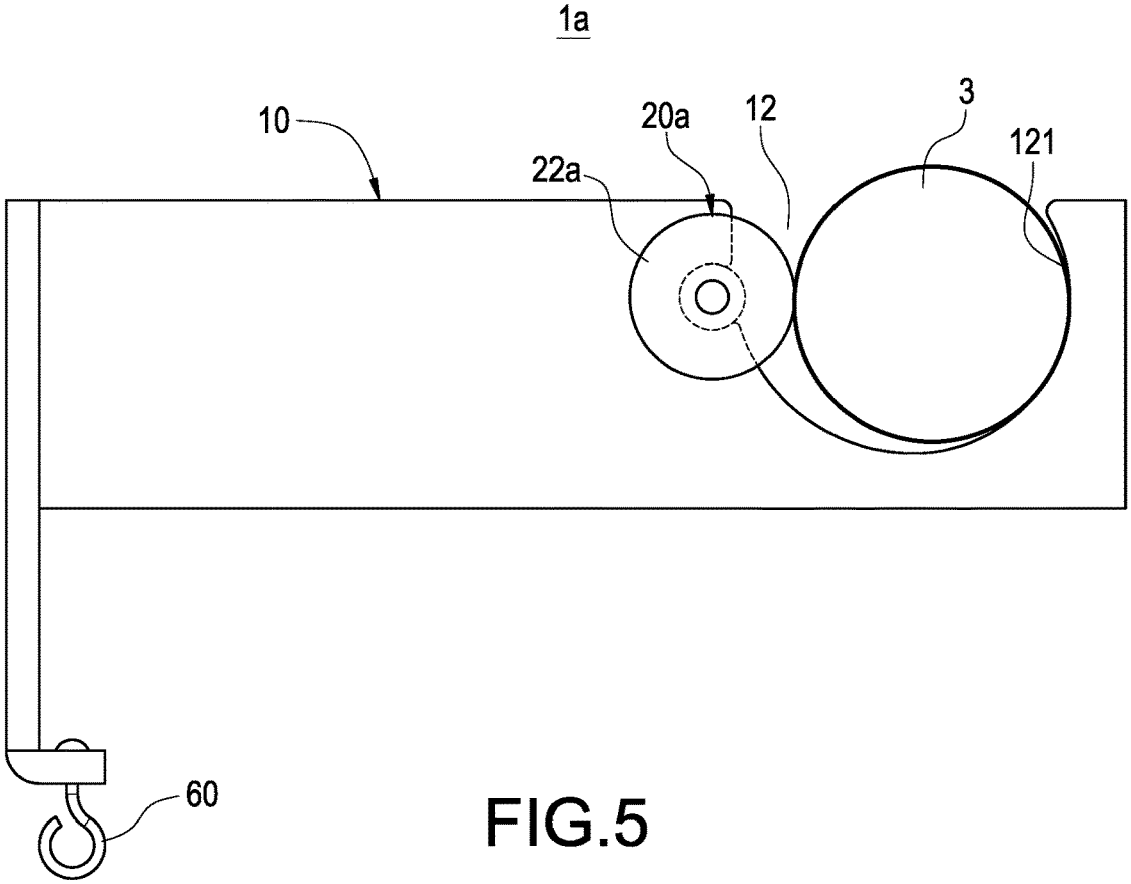
FIG. 5 is another operation schematic view of curtain rod positioning structure of the present invention.

Please refer to FIG. 5, which depict another operation schematic view of the curtain rod positioning structure 1 of the present invention. The curtain rod positioning structure 1 can be used to position curtain rods of different rod sizes. In actual use, the size of the block component is adjusted with respect to the diameter of the rod.

As shown in figures, when another curtain rod 3 having a smaller rod diameter is to be placed in the carrying opening 12, the size of the block component 20*a* needs to be adjusted. In the present embodiment, the diameter of the curtain rod 3 is smaller than that of the curtain rod of FIG. 4; thus, the elastomer 22*a* of the block component 20*a* needs to be enlarged. Thereby, even if the rod diameter of the curtain rod 3 is small, the elastomers 22*a* still can push against the curtain rod 3 in the bearing opening 12, and the curtain rod 3 is positioned between the elastomers 22*a* and the supporting surface 121 of the bearing opening 12.

Figure 6:
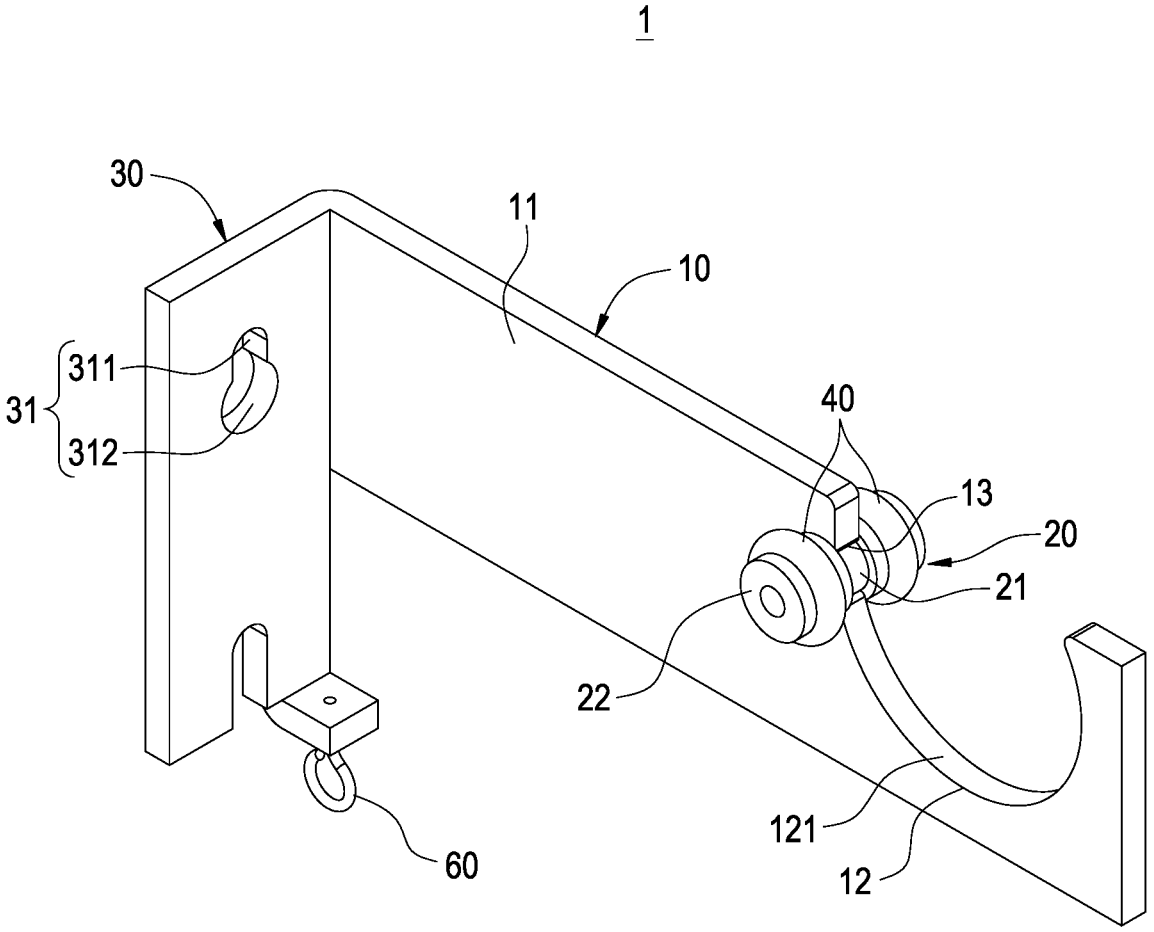
FIG. 6 is another embodiment of curtain rod positioning structure of the present invention.

Please further refer to FIG. 6, it depicts another embodiment of the curtain rod positioning structure of the present invention. This embodiment is substantially the same as the previous embodiment except that the curtain rod positioning structure 1 further includes an O-ring 40, and the O-ring 40 is disposed correspondingly on the elastomer 22 of the block component 20. Preferably, the curtain rod positioning structure 1 includes a pair of O-rings 40, and the pair of O-rings 40 are disposed on the pair of elastomers 22 correspondingly.

Figure 7:
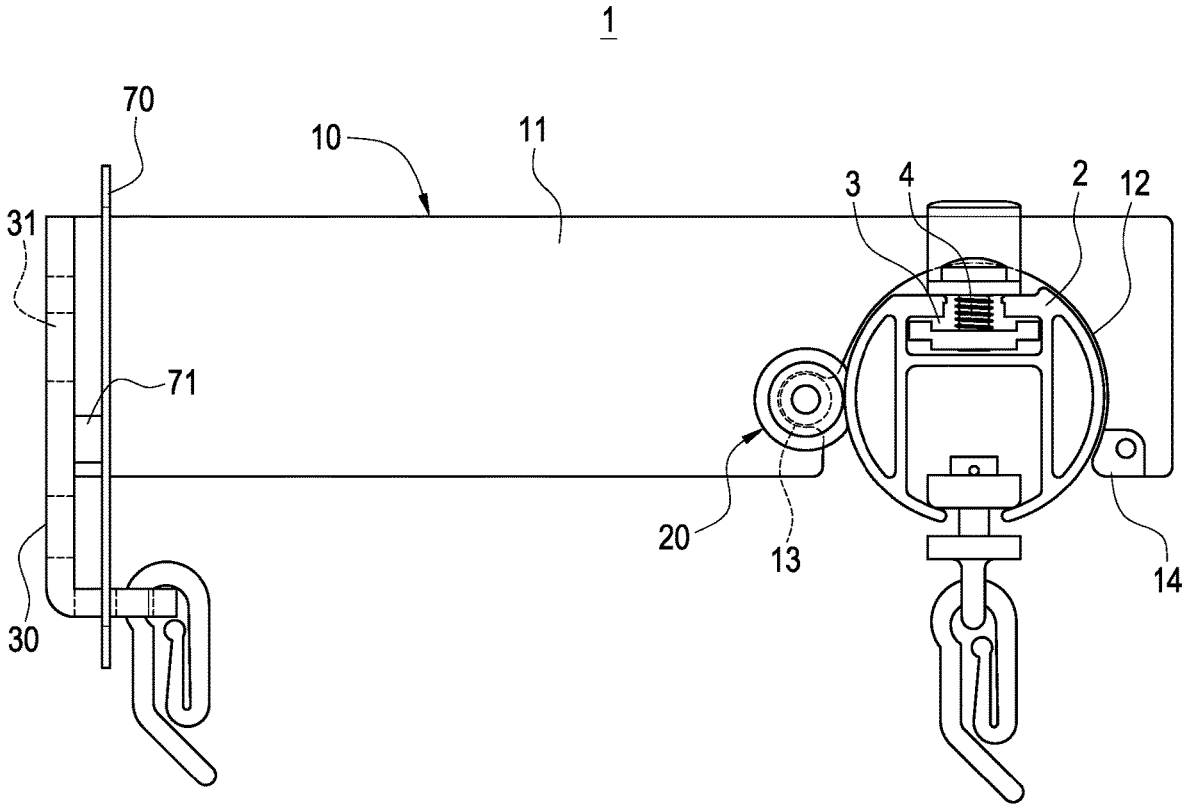
FIG. 7 is a further embodiment of curtain rod positioning structure of the present invention.

With referring to FIG. 7, it depicts a further embodiment of the curtain rod positioning structure of the present invention. In the present embodiment, the curtain rod positioning structure 1 further includes a decoration plate 70. The decoration plate 70 is combined at an outer side of the fixing plate 30 for shielding the locking hole 31 so as to improve the overall aesthetics. It should be noted that the fixing plate 30 is a metal plate, and the decoration plate 70 is provided with a magnet 71 on a side facing the fixing plate 30; thus, the decoration plate 70 can be attached on the fixing plate 30 through the magnet 71.

Furthermore, in the structure of the supporting plate 10, the bearing opening 12 is disposed in a bottom side of the plate 11 so that the curtain rod 2 can be assembled from the lower side of the plate 11 into the bearing opening 12. In addition, the curtain rod has further formed with a slot 3 for inserting a coupling member such as a locking member 4, and the locking member 4 is inserted through the slot 3 and locked to the plate 11. Thereby, the curtain rod 2 is fixed to the supporting plate 10 by the fastening of the locking member 4. It also should be noted that the bearing opening 12 is provided with a chamfer at an opposite side of the buckling hole 13, and a sheath 14 is disposed on the chamfer to prevent the curtain rod 2 from being scratched and to increase the safety of the assembly.

Figure 8:
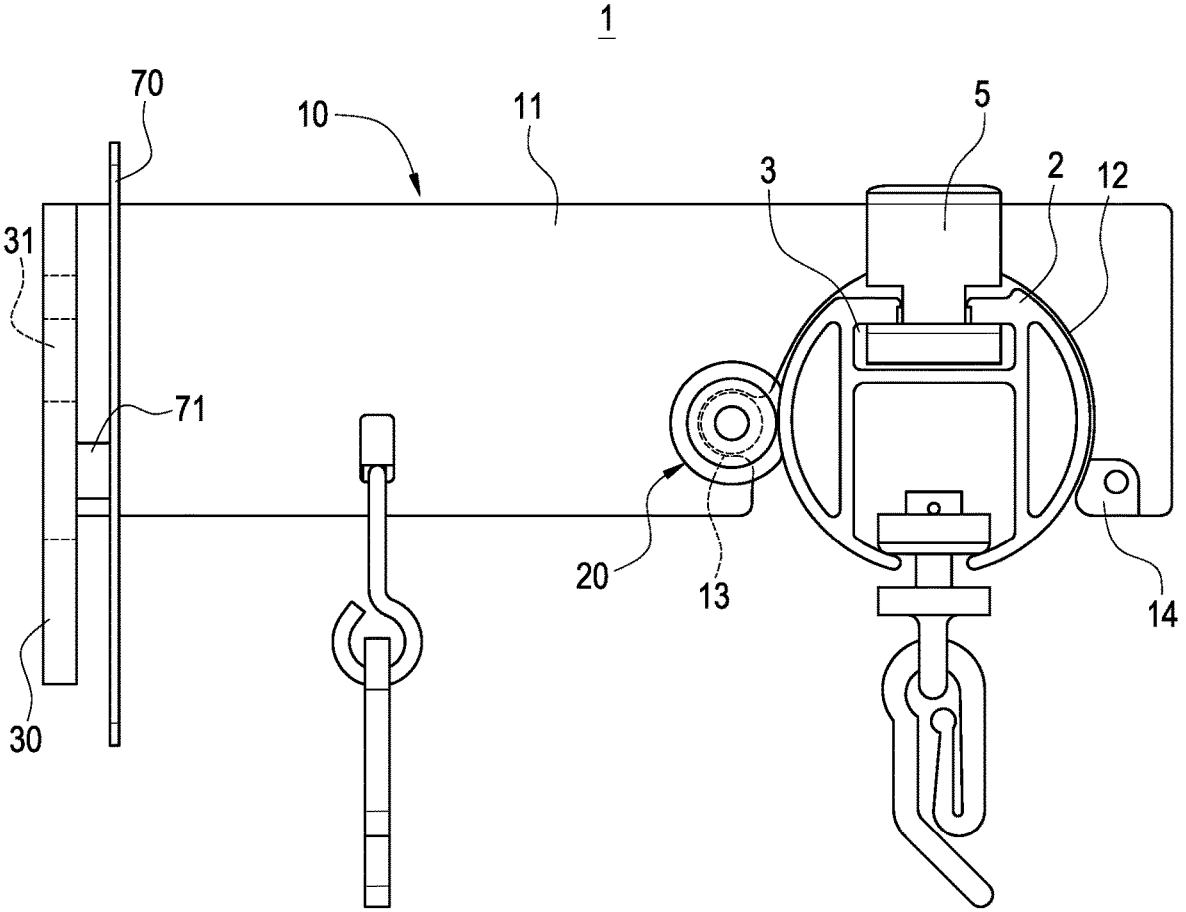
FIG. 8 to FIG. 10 depict a further embodiment of curtain rod positioning structure of the present invention.
Figure 9:
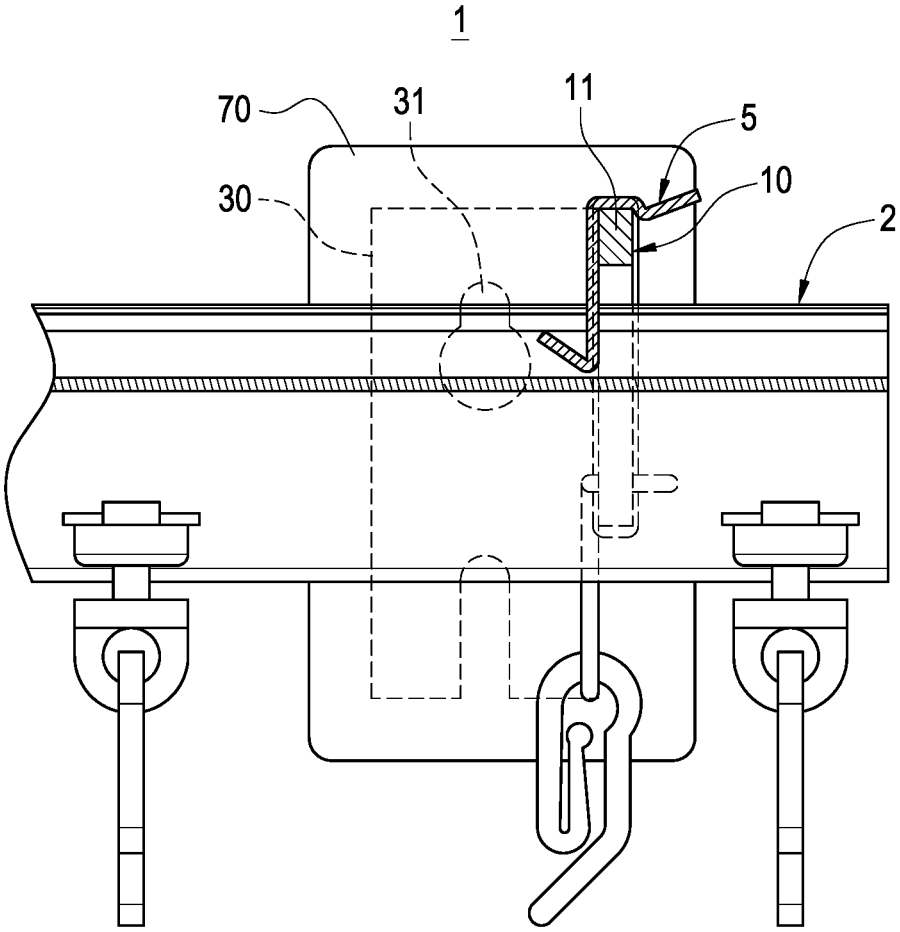
Figure 10:
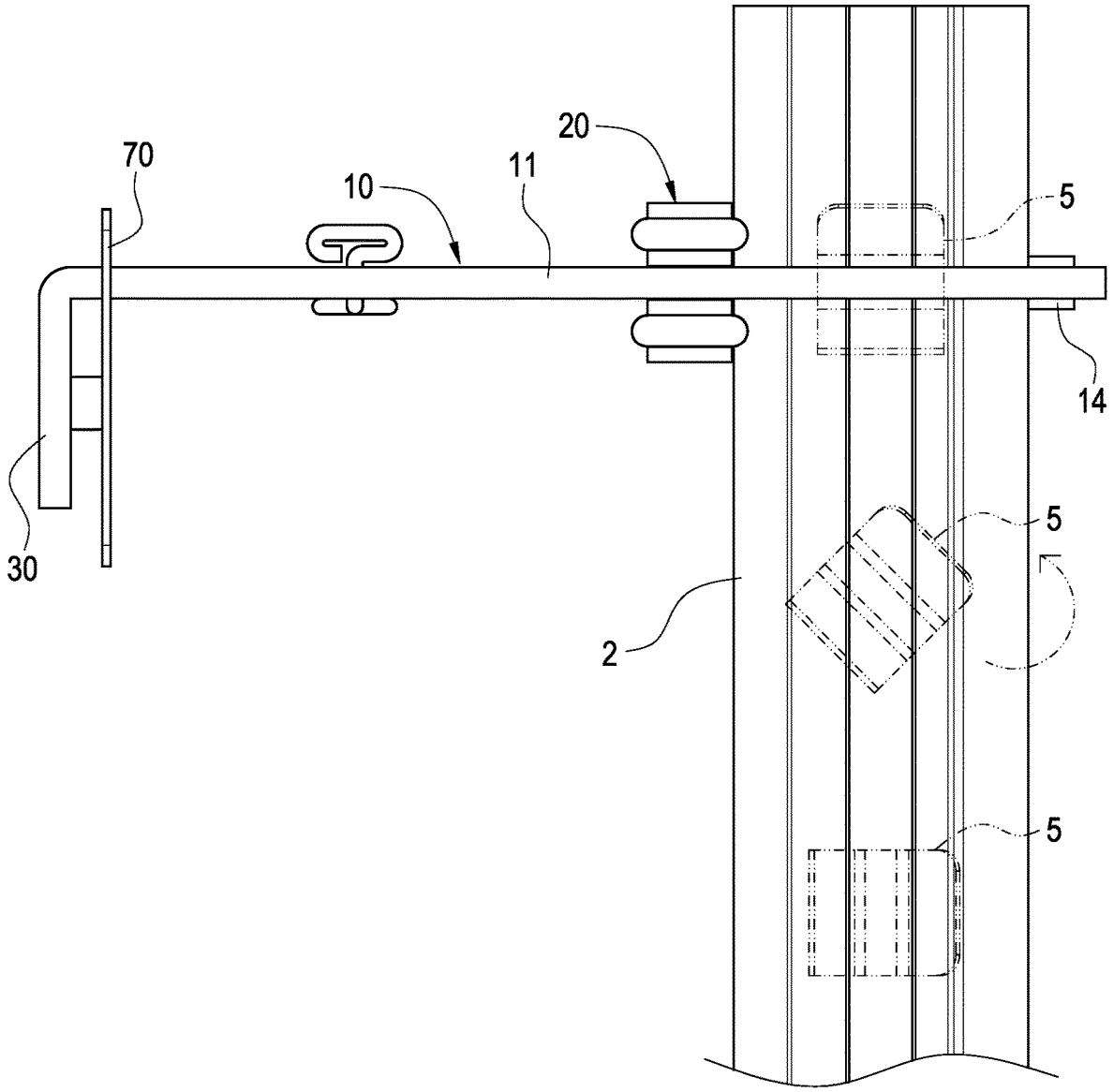

Please also refer to FIG. 8 to FIG. 10, which depict a further embodiment of the curtain rod positioning structure of the present invention. As shown in the figures, the present embodiment is substantially the same as the embodiment shown in FIG. 7. The curtain rod 2 is assembled from the lower side of the plate body 11 into the carrying opening 12, and the curtain rod 2 is formed with a slot 3. The difference in this embodiment is that a coupling member such as a hook 5 is inserted in the slot 3. Moreover, as shown in FIG. 10, it depicts an installation of the hook, wherein one side of the hook 5 is passed through the slot 3 firstly, and then the hook 5 is rotated in the slot 3 by an angle, preferably 90 degrees, and the hook 5 is coupled in the slot 3 without moving out. Therefore, the curtain rod 2 can be fixed to the supporting plate 10 through the rotation of the hook 5.

Although the present invention has been described with reference to the preferred embodiment thereof, it will be understood that the invention is not limited to the details thereof. Various substitutions and improvements have been suggested in the foregoing description, and others will occur to those of ordinary skill in the art. Therefore, all such substitutions and improvements are intended to be embraced within the scope of the invention as defined in the appended claims.

What is claimed is:

1. A curtain rod positioning structure for positioning a curtain rod (2), comprising:

a supporting plate (10) including a plate (11), a bearing opening (12) provided on the plate and a buckling hole (13) communicated with the bearing opening (12), and the bearing opening having a supporting surface (121) to attach the curtain rod;

a block component (20) including a cylinder (21) being capable of inserting in the buckling hole (13) and at least one elastomer (22) connected with the cylinder (21), and a side of the elastomer protruded the supporting surface being able to push against the curtain rod disposed in the bearing opening, so that the curtain rod can be positioned between the elastomer and the supporting surface; and a fixing plate (30) connected with the supporting plate, wherein the fixing plate has a locking hole (31), and the locking hole (31) is provided for inserting a fastening component, and the fixing plate can be combined on a fixing plane through the fastening component.

2. The curtain rod positioning structure according to claim 1, wherein the supporting plate is perpendicularly connected to one side of the fixing plate.

3. The curtain rod positioning structure according to claim 1, wherein the locking hole includes a positioning hole (311) and a through hole (312) which are connected to each other and have different aperture sizes, and an aperture diameter of the through hole is larger than an aperture diameter of the positioning hole.

4. The curtain rod positioning structure according to claim 1, wherein the buckling hole (13) is located at a diameter location of the bearing opening.

5. A curtain rod positioning structure for positioning a curtain rod (2), comprising:

a supporting plate (10) including a plate (11), a bearing opening (12) provided on the plate and a buckling hole (13) communicated with the bearing opening (12), and the bearing opening having a supporting surface (121) to attach the curtain rod; and a block component (20) including a cylinder (21) being capable of inserting in the buckling hole (13) and at least one elastomer (22) connected with the cylinder (21), and a side of the elastomer protruded the supporting surface being able to push against the curtain rod disposed in the bearing opening, so that the curtain rod can be positioned between the elastomer and the supporting surface, wherein the block component (20) includes a pair of elastomers (22), and the pair of elastomers (22) are located at opposite sides of the cylinder.

6. The curtain rod positioning structure according to claim 5, wherein the pair of elastomers (22) are respectively located on two outer sides of the buckling hole (13).

7. The curtain rod positioning structure according to claim 5, further including a pair of O-rings (40), wherein the pair of O-rings (40) are respectively placed on the pair of elastomers (22).

8. The curtain rod positioning structure according to claim 1, wherein the block component (20) is made of rubber or plastic.

9. A curtain rod positioning structure for positioning a curtain rod (2), comprising:

a supporting plate (10) including a plate (11), a bearing opening (12) provided on the plate and a buckling hole (13) communicated with the bearing opening (12), and the bearing opening having a supporting surface (121) to attach the curtain rod;

a block component (20) including a cylinder (21) being capable of inserting in the buckling hole (13) and at least one elastomer (22) connected with the cylinder (21), and a side of the elastomer protruded the supporting surface being able to push against the curtain rod disposed in the bearing opening, so that the curtain rod can be positioned between the elastomer and the supporting surface; and a hanging ring (50), wherein a bottom side of the hanging ring is combined with a screw eye (60).

10. The curtain rod positioning structure according to claim 1, further including a decoration plate (70), wherein the decoration plate is combined at an outer side of the fixing plate for shielding the locking hole.

11. The curtain rod positioning structure according to claim 10, wherein the fixing plate is a metal plate; the decoration plate is provided with a magnet (71) on a side facing the fixing plate, and the decoration plate is attached on the fixing plate through the magnet.

12. The curtain rod positioning structure according to claim 10, wherein the bearing opening (12) is provided with a chamfer at an opposite side of the buckling hole, and a sheath (14) is disposed on the chamfer.

13. The curtain rod positioning structure according to claim 1, wherein the bearing opening is disposed on a bottom side of the plate, and the curtain rod has formed with a slot for inserting a coupling member to fix on the supporting plate.

14. The curtain rod positioning structure according to claim 1, wherein the block component (20) includes a pair of elastomers (22), and the pair of elastomers (22) are located at opposite sides of the cylinder.

15. The curtain rod positioning structure according to claim 14, further including a pair of O-rings (40), wherein the pair of O-rings (40) are respectively placed on the pair of elastomers (22).

16. The curtain rod positioning structure according to claim 9, wherein the block component (20) includes a pair of elastomers (22), and the pair of elastomers (22) are located at opposite sides of the cylinder.

17. The curtain rod positioning structure according to claim 16, further including a pair of O-rings (40), wherein the pair of O-rings (40) are respectively placed on the pair of elastomers (22).

18. The curtain rod positioning structure according to claim 5, further including a fixing plate (30) connected with the supporting plate, wherein the fixing plate has a locking hole (31), and the locking hole (31) is provided for inserting a fastening component, and the fixing plate can be combined on a fixing plane through the fastening component.

19. The curtain rod positioning structure according to claim 18, further including a decoration plate (70), wherein the decoration plate is combined at an outer side of the fixing plate for shielding the locking hole.

20. The curtain rod positioning structure according to claim 19, wherein the fixing plate is a metal plate; the decoration plate is provided with a magnet (71) on a side facing the fixing plate, and the decoration plate is attached on the fixing plate through the magnet.

* * * * *